US005967116A

United States Patent [19]

Kawashima et al.

[11] Patent Number: 5,967,116

[45] Date of Patent: Oct. 19, 1999

[54] JOINT STRUCTURE OF AIR INTAKE SYSTEM HAVING THROTTLE BODY

[75] Inventors: Takasi Kawashima; Kunio Tanaka, both of Nagoya; Hideki Kato, Toyohashi, all of Japan

[73] Assignee: Denso Corporation, Kariya, Japan

[21] Appl. No.: 09/067,028

[22] Filed: Apr. 28, 1998

[30] Foreign Application Priority Data

Jun. 27, 1997 [JP] Japan ..... 9-171493

[51] Int. Cl.[6] ..... F02D 9/00

[52] U.S. Cl. ..... 123/337; 285/423; 285/921

[58] Field of Search ..... 123/337, 472, 123/184.61; 285/325, 423, 921; 251/305

[56] References Cited

U.S. PATENT DOCUMENTS 5,341,773 8/1994 Schulte et al. ..... 123/184.61

5,655,795 8/1997 Strnad et al. ..... 123/337 X

*Primary Examiner*—Tony M. Argenbright

*Attorney, Agent, or Firm*—Nixon & Vanderhye P.C.

[57] ABSTRACT

A joint structure connected to an air intake passage is composed of a throttle body having a set of a groove and a chamfered surface formed on an outer surface thereof diagonally opposite to each other and a joint member having a flexible arm and a rigid arm. The flexible arm has a ridge in engagement with the groove of the throttle body, and the rigid arm has a sloped surface in engagement with the chamfered surface of the throttle body.

10 Claims, 3 Drawing Sheets

JOINT STRUCTURE OF AIR INTAKE SYSTEM HAVING THROTTLE BODY

CROSS REFERENCE TO RELATED APPLICATION

The present application is based on and claims priority from Japanese Patent Application Hei 9-171493, filed on Jun. 27, 1997, the contents of which are incorporated herein by reference.

BACKGROUND OF THE INVENTION

1. Field of the Invention

The present invention relates to a joint structure of an air intake system for an engine having a throttle body.

2. Description of the Related Art

In an air intake system, a throttle body and an intake manifold are usually connected by a plurality of fastening bolts at flange portions respectively formed at the ends of the throttle body and the intake manifold. Therefore, it is necessary to use specific tools for the connection. This takes time and requires careful work.

In order to dispense with the specific tools and to reduce the installation time, U.S. Pat. No. 5,341,773 proposes a resinous joint member of an intake manifold and a throttle body connected by a U-shaped pin. However, because the pin is subject to concentration of mechanical stress, it is difficult to ensure reliability of the connection.

SUMMARY OF THE INVENTION

A main object of the present invention is to provide a reliable joint structure which is easy to be installed without specific tools in a short time.

Another object of the present invention is to provide a joint structure which is composed of a throttle body having a set of a first engagement portion and a second engagement portion respectively formed on the outer surface thereof diagonally opposite to each other and a joint member connected to the air intake passage, in which the joint member has a set of a flexible arm in engagement with the first engagement portion and a rigid arm in engagement with the second engagement portion. The joint structure may be further composed of a fastening bolt fastening the throttle body and the joint member. The joint member may be made of softer material than material of the throttle body. Preferably, the first engagement portion has a groove, the flexible arm has a ridge in engagement with the groove, the second engagement portion has a chamfered surface, and the rigid arm has a sloped surface in engagement with the chamfered surface.

Another object of the present invention is to provide a joint structure connected to an air intake passage which is composed of a throttle body having a plurality of first sets of a first and second engagement portions formed on an outer surface thereof diagonally opposite to each other, and a joint member connected to the air intake passage, in which the joint member has a plurality of second sets of a flexible arm and a rigid arm, and the first engagement portion of each of the first sets is in engagement with the flexible arm of one of the second sets, and the second engagement portion of each of the first sets is in engagement with the rigid arm of one of the second sets.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

First Embodiment

A joint structure of an air intake system for an engine according to a first embodiment of the present invention is described with reference to FIGS. 1 and 2.

Figure 2:
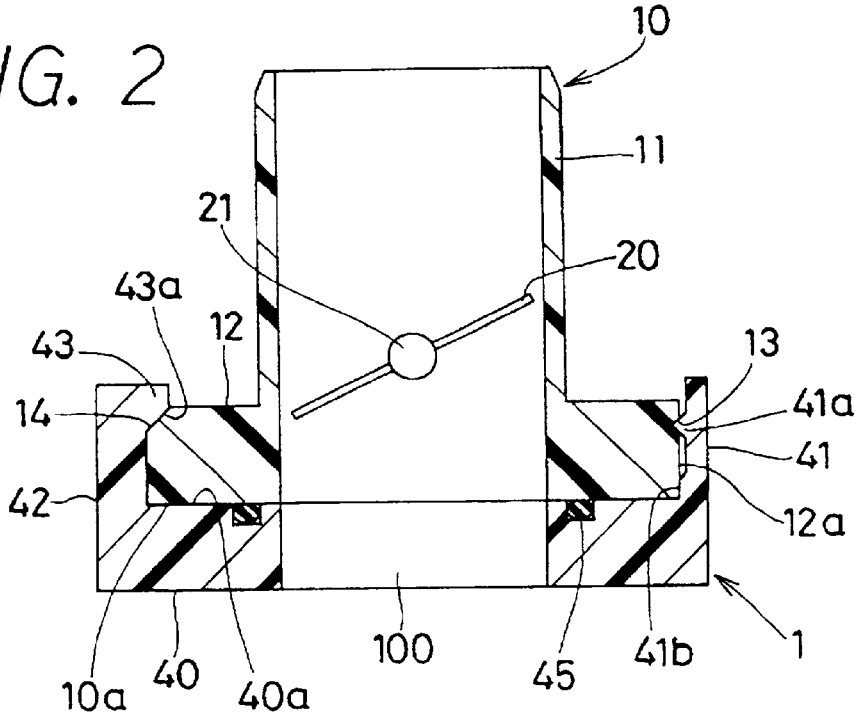
FIG. 2 is a schematic cross-sectional side view of the assembled joint structure according to the first embodiment.

Joint structure 1 is composed of throttle body 10 and joint member 40 which supports throttle body 10 as shown in FIG. 2.

Throttle body 10 is made of resinous material and is provided with throttle valve 20 with throttle shaft 21, cylindrical member 11 in which air passage 100 is formed and flange portion 12. Throttle body 10 can be made of metal also. Flange portion 12 has groove 13 formed at a portion of the outside surface thereof and chamfered surface 14 formed at a portion of the outside surface diagonally opposite to groove 13. Groove 13 and chamfered surface 14 are also formed in the direction perpendicular to the axis of throttle shaft 21.

Joint member 40 is also made of resinous material, such as polybutylen terephthalate (PBT), that is softer than the resinous material of throttle body. Joint member 40 is a portion of the intake manifold (not shown) disposed at a down stream side of throttle body 10, and has intake passage 100 and a set of thin flexible arm 41 and thick rigid thick arm 42 formed at outside portions of joint member 40 diagonally opposite to each other. Flexible arm 41 has V-shaped ridge 41*a* and land 41*b* at the inner surface thereof. Ridge 41*a* is disposed to be fitted into groove 13 of flange portion 12, and land 41*b* is disposed adjacent to the base portion of flexible arm 41 to receive the lower corner of flange portion 12. Rigid arm 42 has hook portion 43 and sloped surface 43*a* extending radially inward at the upper end thereof (in FIG. 1) to engage chamfered surface 14 of throttle body 10.

Throttle body 10 and joint member 40 have flat connecting surfaces 10*a*, 40*a* respectively at the connecting portion thereof, and O-ring 45 is disposed between two connecting surfaces 10*a*, 40*a*.

Figure 1:
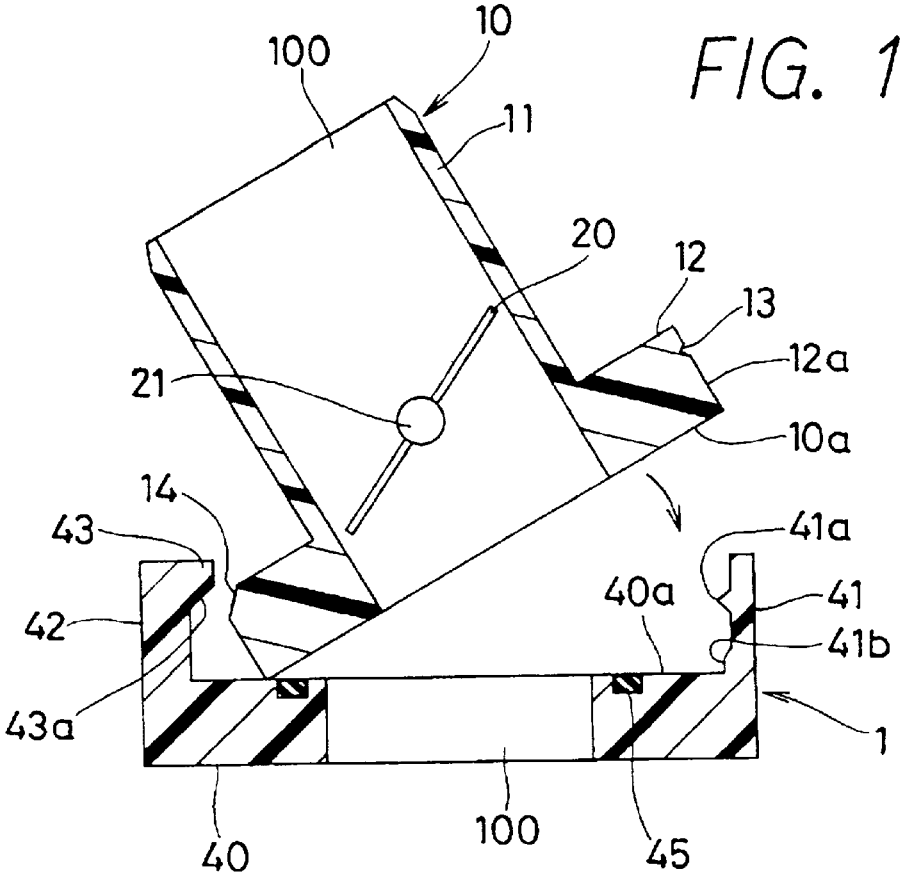
FIG. 1 is a schematic cross-sectional side view of a joint structure in assembling according to a first embodiment of the present invention.

Joint structure 1 is assembled as follows:

(1) As shown in FIG. 1, chamfered surface 14 of throttle body 10 is brought into contact with sloped surface 43*a* of rigid arm 42 of joint member 40, and flexible arm 41 of joint member 40 is bent radially outward to insert flange portion 12*a* until connecting surface 10*a* of throttle body 10 is in contact with connecting surface 40*a* of joint member 40.

(2) Flexible arm 41 is returned to engage ridge 41*a* thereof with groove 13 of throttle body 10 as shown in FIG. 2.

Thus, throttle body 10 is held in joint member 40 by the engagements of chamfered surface 14 with sloped surface 43*a* and groove 13 with ridge 41*a*. Fastening force is applied evenly from arms 41 and 42 so that little damage on joint structure 1 can be expected during the installation work. It is not necessary to fasten throttle body 10 and joint member 40 by bolts or the like.

Second Embodiment

Figure 3:
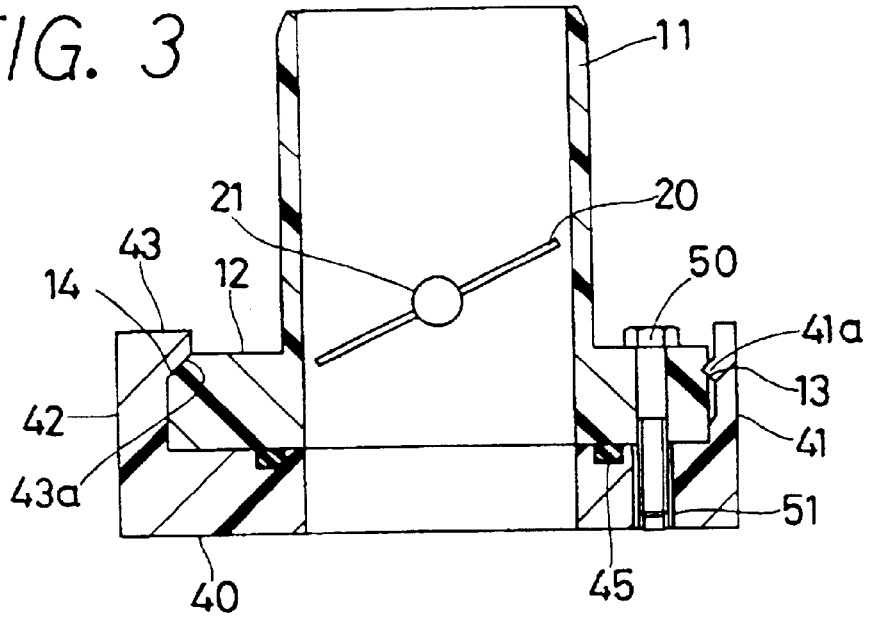
FIG. 3 is a schematic cross-sectional side view illustrating a joint structure according to a second embodiment of the present invention cut along line III—III shown in FIG. 4.

A joint structure according to a second embodiment is described with reference to FIGS. 3 and 4. The same reference numerals indicate respectively the same or substantially the same portions or parts.

Figure 4:
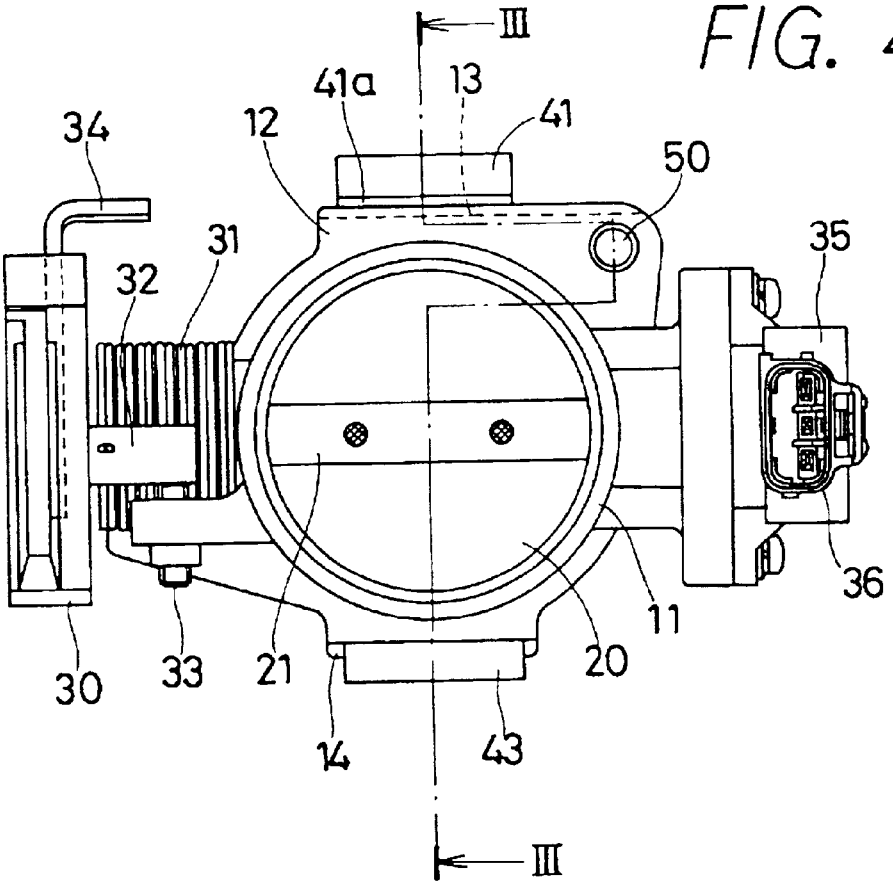
FIG. 4 is a plan view illustrating the joint structure according to the second embodiment.

In FIG. 4, acceleration lever 30 is connected to an acceleration pedal (not shown) of a vehicle and biased by spring 31 to the throttle-closing direction. Acceleration lever 30 has full-close lever 32 and full-open lever 34. Full close lever 32 is stopped by full-close stopper 33 when throttle valve 20 is fully closed, and full-open lever 34 is stopped by a full-open stopper (not shown) when valve 20 is fully opened.

Rotation sensor 35 detects open angle of throttle valve 20 and sends open angle signals to an engine control unit (ECU) through connector 36. Throttle body 20 and joint member 40 are connected in the same manner as the joint structure according to the first embodiment, and, in addition, fastened by single fastening bolt 50 which is screwed into metal collar 51 insert-molded in joint member 40. When throttle body 10 is connected to joint member 40, the sides of throttle body having less projections are inclined as shown in FIG. 1. The installation work can be done without interference with other parts surrounding joint structure 1.

Third Embodiment

Figure 5:
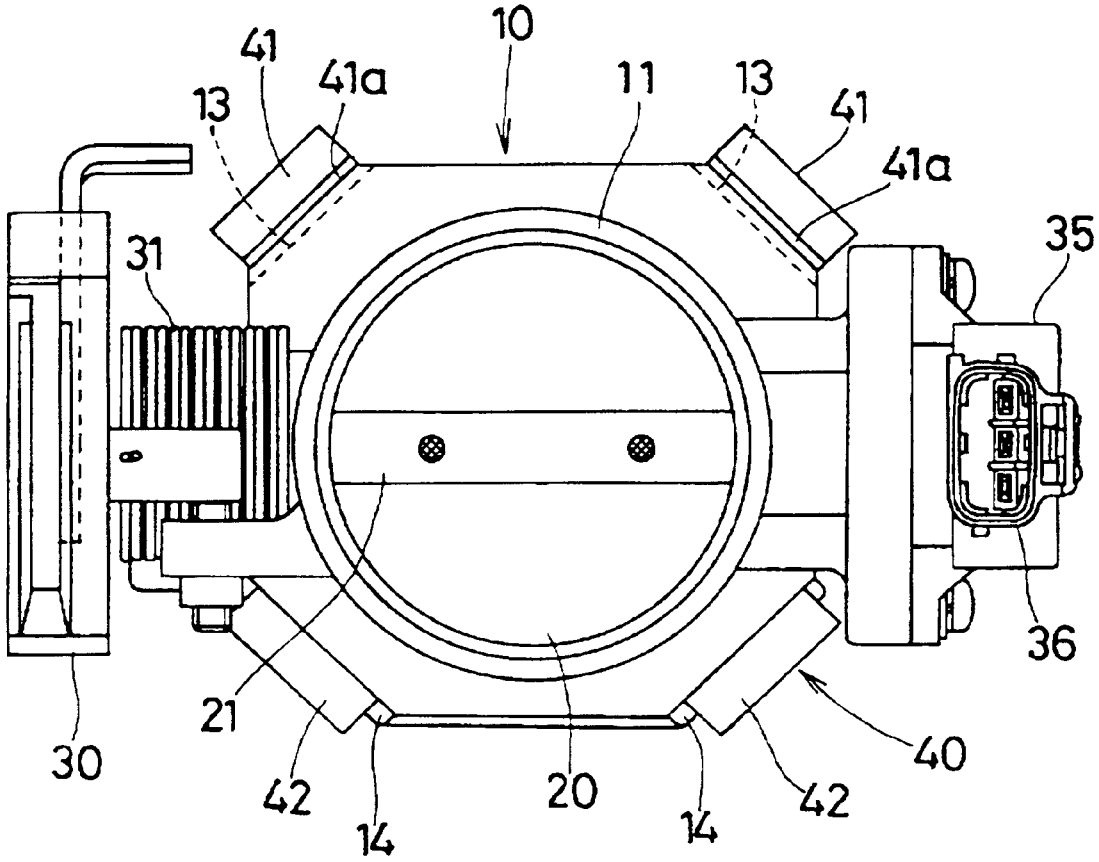
FIG. 5 is a plan view illustrating a joint structure according to a third embodiment of the present invention.

A joint structure according to a third embodiment of the present invention is described with reference to FIG. 5. The same reference numerals indicate respectively the same or substantially the same portions or parts as the first or second embodiment.

The flange portion of throttle body 10 has two sets of groove 13 and chamfered surface 14, and joint member 40 has two sets of flexible arm 41 and rigid arm 42. As in the previous embodiments, each set of groove 13 and chamfered surface 14 is formed at the outside surfaces of throttle body 10 diagonally opposite to each other, and each set of flexible arm 41 and rigid arm 42 is also formed at outside portions of joint member 40 diagonally opposite to each other. The grooves 13 and chamfered surfaces 14 are disposed opposite to each other with respect to throttle shaft 21, and flexible arms 41 and rigid arms 42 are disposed opposite to each other with respect to throttle shaft 21 so that throttle body 10 can be inclined in the direction perpendicular to throttle shaft 21.

Thus, when throttle body 10 is fixed to the intake manifold, throttle body 10 is moved close to the intake manifold in the direction in parallel with throttle shaft 21. Then, a side of throttle body 10 having less projections are inclined as shown in FIG. 1. As a result, throttle body 10 can be installed without interference with parts surrounding joint structure 1, and can be held in joint member 40 more securely.

Variation

Joint member 40 can be integrated with a member, such as a portion of an air cleaner, disposed at the upstream of throttle body 10 in the same manner described above.

In the foregoing description of the present invention, the invention has been disclosed with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than restrictive, sense.

What is claimed is:

1. A joint structure connected to an air intake passage comprising:

a throttle body having a set of a first and second engagement portions formed on an outer surface thereof diagonally opposite to each other; and a joint member connected to said air intake passage, said joint member having a set of a flexible arm in engagement with said first engagement portion and a rigid arm in engagement with said second engagement portion.

2. A joint structure as claimed in claim 1 further comprising a fastening bolt for fastening said throttle body and said joint member.

3. A joint structure as claimed in claim 1, wherein said joint member is made of softer material than said throttle body.

4. A joint structure as claimed in claim 2, wherein said fastening bolt is disposed near said flexible arm.

5. A joint structure as claimed in claim 3, said set of the flexible arm and rigid arm is integrated with said joint member.

6. A joint structure as claimed in claim 1, wherein said first engagement portion has a groove, and said flexible arm has a ridge in engagement with said groove.

7. A joint structure as claimed in claim 6, wherein said second engagement portion has a chamfered surface, and said rigid arm has a sloped surface in engagement with said chamfered surface.

8. A joint structure connected to an air intake passage comprising:

a throttle body having a plurality of first sets of a first and second engagement portions formed on an outer surface thereof diagonally opposite to each other; and a joint member connected to said air intake passage, said joint member having a plurality of second sets of a flexible arm and a rigid arm, wherein said first engagement portion of each of said first sets is in engagement with said flexible arm of one of said second sets, and said second engagement portion of each of said first sets is in engagement with said rigid arm of one of said second sets.

9. A joint structure as claimed in claim 8, wherein said first engagement portion has a groove, and said flexible arm has a ridge in engagement with said groove.

10. A joint structure as claimed in claim 9, wherein said second engagement portion has a chamfered surface, and said rigid arm has a sloped surface in engagement with said chamfered surface.

* * * * *